US006534132B1

(12) United States Patent
Lasson et al.

(10) Patent No.: US 6,534,132 B1
(45) Date of Patent: Mar. 18, 2003

(54) METHOD OF PRODUCING A PRINTING INK-DECORATED PACKAGING MATERIAL, IN PARTICULAR FOR ASEPTIC PACKAGES

(75) Inventors: Rolf Lasson, Lund (SE); Christer Karlsson, Bjärred (SE); Kaj Johansson, Röstånga (SE); Zoltan Pusztai, Staffanstorp (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/423,690

(22) PCT Filed: May 12, 1998

(86) PCT No.: PCT/SE98/00870

§ 371 (c)(1),
(2), (4) Date: Nov. 12, 1999

(87) PCT Pub. No.: WO98/51437

PCT Pub. Date: Nov. 19, 1998

(30) Foreign Application Priority Data

May 14, 1997 (SE) ..... 9701788

(51) Int. Cl.[7] ..... H05H 1/24; B05D 3/06; B05D 3/12; B05D 3/10; B65B 55/10; D21H 21/36

(52) U.S. Cl. ..... 427/536; 427/540; 427/361; 427/365; 427/366; 422/28

(58) Field of Search ..... 427/536, 539, 427/540, 361, 362, 365, 366; 422/28

(56) References Cited

U.S. PATENT DOCUMENTS 3,262,808 A * 7/1966 Crooks et al. ..... 427/536
3,333,032 A 7/1967 Dickinson
3,353,988 A * 11/1967 Wolinski ..... 427/540
3,702,258 A * 11/1972 Gibbons et al. ..... 427/536
3,853,594 A * 12/1974 Moroff ..... 427/361
4,518,651 A * 5/1985 Wolfe, Jr. ..... 427/361
4,664,058 A * 5/1987 Schroeder et al. ..... 118/249
4,698,246 A * 10/1987 Gibbons et al. ..... 427/536
4,719,147 A * 1/1988 Mauri ..... 427/540
4,720,039 A * 1/1988 Nishiguchi ..... 229/487
5,088,643 A * 2/1992 Frazier et al. ..... 427/536
5,137,678 A * 8/1992 Hess et al. ..... 427/361
5,336,528 A * 8/1994 Bohme ..... 427/366
5,356,592 A * 10/1994 Balla et al. ..... 422/28
5,378,477 A * 1/1995 Johnson et al. ..... 427/361
5,393,566 A * 2/1995 Propst ..... 427/361
5,445,793 A * 8/1995 Tuckner et al. ..... 422/28
5,478,618 A 12/1995 Rosén
5,484,660 A 1/1996 Rosén
5,512,333 A * 4/1996 Suskind ..... 427/536
5,540,885 A * 7/1996 Pahlmark et al. ..... 422/28
5,653,383 A * 8/1997 Adachi et al. ..... 229/125.15

FOREIGN PATENT DOCUMENTS

WO WO94/14606 7/1994

* cited by examiner

*Primary Examiner*—Marianne Padgett
(74) *Attorney, Agent, or Firm*—Burns, Doane, Swecker & Mathis, L.L.P.

(57) ABSTRACT

A method is disclosed for producing a printing ink decorated packaging material. The packaging material heat sealable outer coatings. One or both sides of the packaging material are subjected to corona discharge surface treatment to increase the surface tension. Printing is applied to the treated surface. The packaging material then passes the nip between heated rollers in order to reduce the surface energy of the outer plastic layers. Subsequently, a surface treatment of hydrogen peroxide is applied to the packaging material to sterilize the surface.

7 Claims, 1 Drawing Sheet

Figure 1:
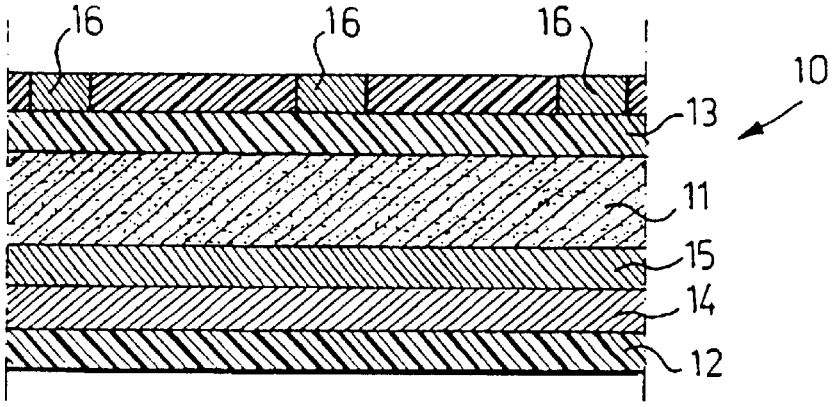

METHOD OF PRODUCING A PRINTING INK-DECORATED PACKAGING MATERIAL, IN PARTICULAR FOR ASEPTIC PACKAGES

FIELD OF THE INVENTION

1. Technical Field

The present invention relates to a method of producing a printing ink-decorated packaging material of laminate type, which has, on its outside, applied decor of water-based printing.

2. Background Art

BACKGROUND OF THE INVENTION

In the packaging industry, use is often made of liquid-tight, dimensionally stable packages of the single use disposable type for packing and transporting liquid foods.

Single use disposable packages of the type under consideration here are typically produced from a packaging material of laminate type comprising a rigid, but foldable core layer of paper which, at least on its one side, has an outer coating of plastic which serves as the decor carrier and which is preferably low density polyethylene (LDPE) having, applied on its outside, decor of water-based printing ink. Preferably, the core layer also has an outer coating of plastic, normally low density polyethylene (LDPE) on its other side as well, whereby the packaging material makes for the production of dimensionally stable, liquid-tight packages by means of simple, effective thermosealing.

In certain cases, in particular when the packaging material is to be employed for so-called aseptic packages, the packaging material is also provided with a material layer which serves as gas barrier and is disposed between the core layer and that one of the two outer plastic coatings which is intended to be turned to face inwards when the packaging material is reformed into packages. The material in this gas barrier layer may be a so-called barrier polymer, for example polyamide, or ethylene vinyl alcohol copolymer, but most generally consists of an aluminium foil (so-called Alifoil).

Nowadays, dimensionally stable, liquid-tight packages are most generally produced with the aid of modern, high-speed packing and filling machines of the type which, either from a web or from prefabricated sheet blanks of the packaging material, form, fill and seal the packages. From, for example a web, the packages are produced in that the web is first reformed into a tube by both longitudinal edges of the web being united with one another in an overlap joint seal. The tube is filled with the relevant contents, for example liquid food, and is divided into closed, filled packages by repeated transverse seals transversely of the longitudinal axis of the tube below the level of the contents in the tube. The packages are separated from one another by incisions or cuts in the transverse sealing zones and are given the desired geometric, normally parallelepipedic configuration, by a further forming and sealing operation for the formation of the finished packages.

So-called aseptic packages are produced fundamentally in the same manner, but with the crucial difference that both the packaging material and the relevant contents are sterilized prior to the filling phase, and that the filling phase takes place in a sterile (aseptic) filling atmosphere so as to avoid reinfection of the sterilized contents.

A sterilization of the packaging material often takes place with the aid of a chemical sterilizing agent, for example an aqueous solution of hydrogen peroxide, with which the packaging material is brought into contact for destroying unwanted, in particular pathogenic micro-organisms on at least those parts of the packaging material which come into contact, or risk coming into contact with the sterilized contents. However, the entire packaging material is often sterilized in that a web of the packaging material is led down into and through a bath of aqueous hydrogen peroxide which, for the above-mentioned purpose of sterilization, is allowed to act on the packaging material web prior to reforming of the web into aseptic packages as described above.

Printing inks for the described application in connection with packaging materials are often water-based and therefore require that the surface on which they are to be applied is sufficiently hydrophilic to achieve good adhesion between the water-based printing ink and the relevant printing surface.

A surface of polyethylene, e.g. LDPE, which is used as printing surface in the above described prior art packaging material is, however, hydrophobic (water repellent) and must therefore be modified in order to make for the desired good adhesion between printing ink and printing surface. For the purpose of promoting adhesion, the packaging material according to the prior art technique is therefore subjected to a surface treatment which changes its polarity by means of electric corona discharges, as a result of which the polyethylene surface obtains the desired hydrophilic character.

While it has thus previously been possible to produce a printing inkdecorated packaging material of the type described by way of introduction with good adhesion between the water-based printing ink and the outer polyethylene coating of the packaging material, it has surprisingly proved that the prior art packaging material, in particular for aseptic packages, may be improved considerably using only simple means.

SUMMARY OF THE INVENTION

By subjecting the printing ink-applied web of packaging material to a surface energy-reducing after treatment, as in the method according to the present invention, it is possible to produce a printing ink-decorated packaging material which not only withstands storage in a damp environment even for lengthy storage times, without the decor losing its clarity and freshness, but which also can be sterilized using aqueous hydrogen peroxide, as described above, with considerably lower consumption of hydrogen peroxide than has hitherto been possible using the prior art methods.

One explanation for the above described drawbacks inherent in the prior art printing ink-decorated packaging material, i.e. moisture sensitivity on storage and excessively high hydrogen peroxide consumption in connection with sterilization, may be that a corona treatment, at the same time as it realises modification (change of polarity) of the decor-carrying polyethylene coating of the packaging material, is sufficiently powerful that the polyethylene coating is "broken up" when it is hit by the electric corona discharges. Within such "broken up" regions the polyethylene coating wholly or partly lacks hydrophilic seats which are required for the waterbased printing ink to adhere with good adhesion, as a result of which the printing ink thus only partly adheres within these regions. The risk of interaction between printing ink and moisture or liquid and consequential deterioration in the quality of the applied decor has thus increased within the above mentioned regions.

The problem with "broken up" material regions of the outer polyethylene coating of the packaging material becomes particularly serious when the packaging material is, for the purpose of sterilization, led through a bath of aqueous hydrogen peroxide, as in the production of aseptic packages. Apart from the fact that the printing ink comes into contact and interacts with the water in the hydrogen peroxide solution, hydrogen peroxide will be excessively attracted and absorbed by exposed hydrophilic seats in the polyethylene coating also in regions outside the applied printing ink decor, with excessive hydrogen peroxide consumption as a result.

By subjecting the corona-treated outer polyethylene coating of the packaging material to a surface energy-reducing after treatment by means of heat, the above described drawbacks in connection with the prior art packaging material are thus effectively obviated.

Preferably, the surface energy-reducing after treatment is carried out by means of hot press rollers or press cylinders between which the packaging material is led, whereby a physical levelling effect on the "broken up" polyethylene coating is also achieved, which, together with the reduced surface energy, further contributes in counteracting the tendency of the corona-treated polyethylene coating to absorb liquid (water).

BRIEF DESCRIPTION OF THE ACCOMPANYING DRAWING

Figure 2:
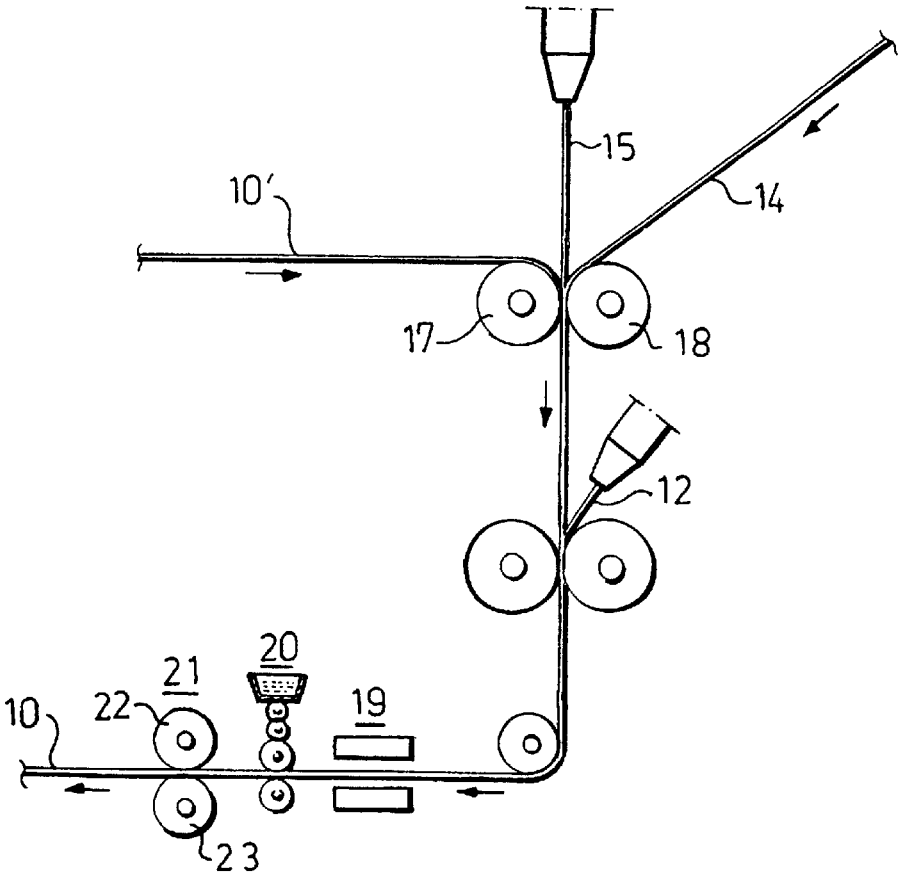

The present invention will now be described in greater detail hereinbelow, with particular reference to the accompanying Drawing, in which:

FIG. 1 is a schematic a cross sectional view of a packaging material for asceptic packages, which is produced employing the method of the present invention; and FIG. 2 is a schematic view of the process of this invention.

DETAILED DESCRIPTION OF THE INVENTION

In FIG. 1, the schematically illustrated packaging material has been given the generic reference numeral 10. The packaging material 10 comprises a core layer 11 of rigid, but foldable paper of conventional packaging quality, and outer, liquid-tight coatings 12 and 13 of polyethylene, preferably low density polyethylene (LDPE). Between the paper layer 11 and one of the two outer polyethylene coatings 12, there is provided an aluminium foil 14 (so-called Alifoil) serving as gas barrier which, by means of an inteojacent layer 15 of adhesive, is bonded to that side of the core layer 11 which is intended to face inwards when the packaging material is reformed into packages.

As will be apparent from FIG. 1, the second outer polyethylene coating 13 of the packaging material 10 has an applied decor 16 of water-based printing ink which, using conventional printing technique, is applied in the desired decorative pattern on the outside of the polyethylene coating 13.

The packaging material 10 in FIG. 1 is produced according to the invention in the manner which is schematically illustrated in FIG. 2. In order to facilitate a comparison, the same parts in FIG. 2 have been given the same reference numerals as in FIG. 1.

A web 10' of plastic-coated paper is unwound from a magazine reel (not shown) in the direction of the arrow and is provided with a foil 14 of aluminium which serves as gas barrier and which, by means of an extruded interjacent layer 15 of adhesive, is laminated to the one side of the web in connection with the web's being led through a nip between two rollers or cylinders 17 and 18.

The foil-clad web is thereafter led to an extrusion station in which the aluminium foil is covered with a film 12 of polyethylene, preferably low density polyethylene (LDPE), which is extruded on the outside of the aluminium foil 14 for the formation of the one outer plastic coating 12 of the packaging material 10.

The plastic-coated web is then subjected, for the purpose of promoting adhesion, to a surface treatment at 19 modifying its polarity, where the web's second outer coating 13 of polyethylene, preferably low density polyethylene, is surface modified by means of electric corona discharges in a per se known manner.

The corona-treated web is led further to a printing station 20 in which the web is, using conventional printing technique, provided with outer decor 16 of water-based printing ink which is applied in the desired pattern on the outside of the surface-modified outer polyethylene coating 13 of the web.

The web is finally led to an after treatment station at 21 in which the web, in accordance with the present invention, is led through the nip between two hot press rollers or press cylinders 22, 23, whereby the surface energy of the corona-treated, printing ink coated outer plastic coating 13 of the web is reduced at the same time as the plastic coating 13 is levelled out somewhat.

In a practical comparative experiment, a packaging material according to the invention for aseptic packages has proved susceptible to sterilization with a hydrogen peroxide consumption which is approximately 70 per cent lower than corresponding hydrogen peroxide consumption in a known packaging material which has not been subjected to an after treatment for the purpose of reducing surface energy, in sterilization employing a bath of aqueous hydrogen peroxide in the previously described manner.

It will thus be apparent from the foregoing description that the present invention, in a simple manner and using simple means, makes.for the production of a printing ink-decorated packaging material, in particular for aseptic packages, with surprisingly advantageous properties.

Naturally, many modifications and alterations are possible without departing from the inventive concept as herein disclosed. Such modifications and alterations, obvious to a person skilled in the art, thus lie within the spirit and scope of the inventive concept as this is defined by the appended Claims.

What is claimed is:

1. A method for producing a printing ink-decorated packaging material, comprising:

(a) forming a laminate having a paper core layer with heat sealable outer plastic layers on opposite sides of the paper core, (b) applying a corona discharge surface treatment to at least one of the outer plastic layers;

(c) applying a water-based printing ink to the at least one outer plastic layers to which the corona discharge surface treatment has been applied;

(d) reducing the surface energy of the at least one outer plastic layers to which the corona discharge surface treatment has been applied; and (e) subsequently applying a surface treatment of hydrogen peroxide to the at least one outer plastic layer, wherein the reducing the surface energy includes heating the surface of the at least one outer plastic layers, and wherein reducing the surface energy after printing causes the decorated packaging material to absorb less hydrogen peroxide during sterilization of the plastic coated web.

2. The method as claimed in claim 1, wherein said at least one outer plastic layer is formed of low density polyethylene.

3. The method as claimed in claim 1 wherein the reducing the surface energy includes passing the laminate through a nip between heated rollers.

4. The method as claimed in claim 1 wherein the laminate is formed into packaging containers after the step of applying a surface treatment of hydrogen peroxide by heat sealing together portions of the at least one outer plastic layers.

5. A method for producing a printing ink-decorated packaging material for use in making heat sealed liquid food packages, comprising:

(a) advancing a web of plastic coated paper to pass through a nip by a first pair of rollers, (b) advancing a web of a gas barrier material to pass through the first pair of rollers, (c) applying an adhesive into the nip of the first pair of rollers between the plastic coated paper and the gas barrier material, (d) applying a heat sealable plastic layer over the gas barrier material, (e) applying a corona discharge surface treatment to the plastic surface of the plastic coated paper, (f) applying a water based printing ink to the plastic surface of the plastic coated paper, (g) reducing the surface energy of the surface of the plastic coated paper, and (h) subsequently applying a surface treatment of hydrogen peroxide to the plastic coated paper whereby the corona discharge surface treatment improves the adhesion of the ink coating, and reducing the surface energy after printing causes the decorated packaging material to absorb less hydrogen peroxide during sterilization of the plastic coated web, wherein the reducing the surface energy includes passing the plastic coated paper between heated press rollers.

6. The method as claimed in claim 5, wherein the heat sealable plastic layer is formed of low density polyethylene.

7. The method as claimed in claim 5, wherein the gas barrier material is aluminum foil.

* * * * *